United States Patent [19]

Gosciniak et al.

[11] Patent Number: 4,509,563

[45] Date of Patent: Apr. 9, 1985

[54] DEVICE FOR THE INSERTION OF A WEFT THREAD INTO THE SHED BETWEEN TWO LINES OF WARP THREAD IN A WEAVING LOOM

[75] Inventors: Guy Gosciniak, Illfurth; Yves Juillard; Pierre Menissier, both of Mulhouse, all of France; Albert Moessinger, Vaud, Switzerland

[73] Assignee: Mecaniques de Mulhouse Societe Alsacienne de Constructions, France

[21] Appl. No.: 537,844

[22] Filed: Sep. 30, 1983

Related U.S. Application Data

[63] Continuation-in-part of Ser. No. 239,577, Mar. 2, 1981, abandoned.

[51] Int. Cl.[3] ..... D03D 47/12; D03D 47/36

[52] U.S. Cl. ..... 139/443; 139/452

[58] Field of Search ..... 139/429, 430, 435, 449, 139/443, 452

[56] References Cited

U.S. PATENT DOCUMENTS

| | | | |
|---|---|---|---|
| 3,543,808 | 12/1970 | Moessinger | 139/127 |
| 3,675,687 | 7/1972 | Vermerren et al. | 139/127 P |
| 3,938,561 | 2/1976 | Scheffel | 139/122 H |

FOREIGN PATENT DOCUMENTS 7508359 7/1975 Netherlands .

OTHER PUBLICATIONS

"Textile Institute and Industry", Mar. 1970, pp. 65–70.

*Primary Examiner*—Henry S. Jaudon
*Assistant Examiner*—Steven N. Meyers
*Attorney, Agent, or Firm*—Arnold White Durkee

[57] ABSTRACT

A device for the insertion of a weft thread into the shed of a weaving machine is equipped with a delivery system for depositing a pick of weft thread from a weft thread storage space into a thread collecting unit; an insertion mechanism, placed between the delivery system and the thread collecting unit, which is adapted to intermittently insert, in synchronism with the cycle of the loom, the pick of weft thread into the shed between the warp threads; and a novel feeding system for feeding the pick of weft thread from the thread collecting unit to the insertion mechanism. The feeding system may be adapted to move unidirectionaly or alternately, or continuously or intermittently. This system is equipped with gripping devices that move through a predetermined path which is outside the trajectory of the insertion device. As the grippers move through their path the pull the pick or weft thread such that it is fed into the insertion mechanism.

15 Claims, 22 Drawing Figures

DEVICE FOR THE INSERTION OF A WEFT THREAD INTO THE SHED BETWEEN TWO LINES OF WARP THREAD IN A WEAVING LOOM

BACKGROUND OF THE INVENTION

This application is a continuation-in-part of Application Ser. No. 239,577, now abandoned, filed Mar. 2, 1981.

This invention relates to an improved weaving technique by which a weft thread is inserted into a shed between two lines of warp thread without using any shuttle.

The various techniques known today which permit inserting a weft thread into the shed between two lines of warp thread, without making use of a shuttle, can be classified into the three following categories:

- the category in which a fluid vector (air jet, water jet) is utilized to carry the weft thread from one side of the shed to the other,
- the category in which a device is utilized for throwing or projecting (flexible or rigid), by means of which the weft thread is caught and moved across the shed,
- finally, the much more recent category, known under the name of "inertia insertion", which is described in the French Pat. No. 1,562,147 (corresponding to the U.S. Pat. No. 3,543,808), and consists of casting the weft thread in the shape of a loop. One of the strands (called the "cast strand") of this loop has one free end and is cast at high speed inside the space between two lines of warp thread; the other strand (called the "locked strand") is held by a gripper outside of the shed space.

In all these techniques, the pick of weft thread is prepared for casting by storing predetermined lengths of thread. Usually a delivery system for pulling the weft thread stored on the feeding spool is utilized to deliver thread to a storage space which can be a reduced pressure chamber.

One of the main problems with these techniques of shuttleless weft insertion is the problem of synchronizing the cycle of the weaving loom with the casting of the weft thread into the shed and with the storage of the thread for the next pick of weft thread. This problem increases with the speed at which the weaving is performed.

The present invention relates to an efficient device, easily applicable to practically all types of shuttleless weaving looms which necessitate the preparation of a pick of weft thread, and its storage before being cast into the shed. It allows a perfect synchronization with the cycle of the weaving loom.

The invention will be further described with reference to its application to the inertia insertion technique summarized above; but it will be readily apparent to those familiar with the art that this invention is not limited to this specific application, but can also be used in any other type of shuttleless weaving loom. As mentioned before, according to the inertia insertion technique, the weft thread is cast into the space between two lines of warp thread in the shape of a loop with one cast strand and one locked strand. Thus, the kinetic energy within the cast strand changes, inside the loop, into a force pulling the thread in the direction of the loop's motion; this force may be stronger than the air resistance.

The cast strand propulsion is produced either by means of a lever with a pin or a pulley at its free end, simultaneously accelerating the loop and the thread, or by squeezing the loop between rotating units consisting of two cylindrical or conical rollers each with a velocity at its periphery equal to the desired velocity for casting the thread.

The invention will be described in particular with reference to this technique where the casting is effected by squeezing the thread between two rotating units.

A solution permitting synchronization of such a casting system with the cycle of the weaving loom, as well as with the formation of a stationary supply of thread to be cast, is described in the periodical "Textile Institute and Industry—March 1970". This solution consists in utilizing two casting rollers which are moved apart for a while to insert the thread to be cast, then brought back together closely to hold the thread and pull it. This solution presents some difficulties. As a matter of fact, one of the two rollers at least must be able to complete a movement of translation perpendicular to its axis in order to be moved away from the other roller, so that the thread may be inserted perpendicularly to the common generatrix.

Thus, since the two rollers must have the same outer speed to minimize the friction and position the thread in a well defined direction, the fact that the rollers must be separated for a while therefore requires that they both be driven into motion. Moreover, the loop must be prepared in advance, which necessitates an additional mechanism which, in a general manner, essentially consists of a ring rotating within its plane, and having, on the same side with respect to its center, two grippers in radial arrangement, one near the ring's inner circumference and the other near the ring's outer circumference. A cutting device cuts the thread between these two grippers, and the third stationary gripper is situated near the casting rollers which may be moved apart from each other to receive the thread, then brought back close to each other to cast the thread.

A storage space used for the supply of thread is arranged vertically and concentrically to the ring. The common generatrix of the rollers when they are in contact is situated within the limits of the ring area. The layout of the ring and of the thread storage space, in particular, makes it difficult to have this ring rotate and requires a rather complicated system; moreover, as mentioned before, it is necessary to separate the rollers so the thread may be inserted between them. The author himself acknowledges the difficulty of his project.

SUMMARY OF THE INVENTION

The present invention aims at eliminating these difficulties and relates to a device which not only can be used in combination with an insertion system comprising two rotating rollers, but which can easily be adapted to be used in combination with other types of systems that permit the insertion of a weft thread into the shed of a weaving loom, such as for instance, a system making use of jets of air or water, or a system for throwing or gripping the weft thread and forcing it through the shed.

In a general manner, the invention therefore relates to a device for the insertion of a weft thread into the shed of a weaving loom, which includes the following elements:

a delivery system which deposits the pick of weft thread from a storage space into a thread collecting unit, an insertion system, placed between the delivery system and the thread collecting unit to insert a weft thread into a shed synchronously with the cycle of the loom, a feeding system cooperating with the insertion system to introduce the pick of weft thread into the insertion system.

This feeding system is placed between the delivery device and the insertion system or device, and is equipped with gripping devices for grasping the pick of weft thread. The feeding device in operation moves through a set path, which can be unidirectional or alternating, which path is outside of the path of the insertion device. The path of the feeding device cuts across the trajectory of the thread between the delivery device and the thread collecting unit so that the gripping devices engage the weft thread and carry the thread to the zone where the insertion devices operate. The feeding device can be designed to operate continuously or intermittently.

The gripping device preferably drives the strand of thread towards the point after the last row of finished cloth has been woven, so that the thread can be inserted in the shape of a loop in the shed of a weaving loom.

In the case of an insertion device comprised of a pair of rollers which permit insertion of the weft thread in the shape of a loop with one strand locked and one strand cast, the rollers can be maintained in a permanent tangential contact. The grippers of the feeding device by moving unidirectionally through a set path having a surface outside the generatrix common to the casting rollers permit introduction of the weft thread between the rollers. In this type of design, the gripping device also constitutes the stationary point of the locked strand of the loop which unwinds inside the shed. After the weft thread has been inserted it is cut and released by the gripper. The free end of the cut thread retracts into the storage unit.

In the case of another insertion device (casting system, throwing system or the like) the means for gripping the thread moves through a predetermined path which has a surface outside the path of the insertion device. In all cases, the path of the gripper on the feeding device crosses the path of the thread between the delivery device and the thread collecting unit; the gripper then carries the thread through a path which intersects with the insertion device so that the thread is fed into the insertion device.

The driving unit which supports the gripping means preferably moves unidirectionally at a speed which may be constant, or vary intermittently, for instance by means of a Maltese Cross System.

It is an advantage that the pick of weft thread prepared is being stretched by a jet of air, according to a well defined trajectory, between the delivery unit and the entrance to the thread collecting unit. The pick of weft thread is preferably stored inside the thread collecting unit in a plane close to the tangential plane common to both casting rollers.

The gripping devices permit the introduction of the picks of weft thread between the casting rollers. The grippers may for instance, describe a circumference nearly in the tangential plane common to the casting rollers, and be adapted so that they open and close automatically.

In a general manner, the driving unit moving unidirectionally shall be equipped with "n" grippers fixed at the same angular distance on the circumference of a plate or disc rotating at a speed equal to 1/n times the rate of a weaving machine. In an alternative embodiment where the number of grippers is an even number, one out of two grippers may be replaced by a cutting tool placed in such a way that it may be possible to insert the picks of weft thread by pairs without any gap between them, and the cutting tools may serve as gripping means for the second pick of weft thread of each pair. In all cases, the gripping devices may be pliers—grippers holding the thread below its cutting point.

BRIEF DESCRIPTION OF THE DRAWING

The invention and the advantages derived therefrom shall however be better understood with the help of the following examples which do not limit the scope of the invention, but are given as a guide hereinafter with the attached drawings.

DETAILED DESCRIPTION

Figure 1:
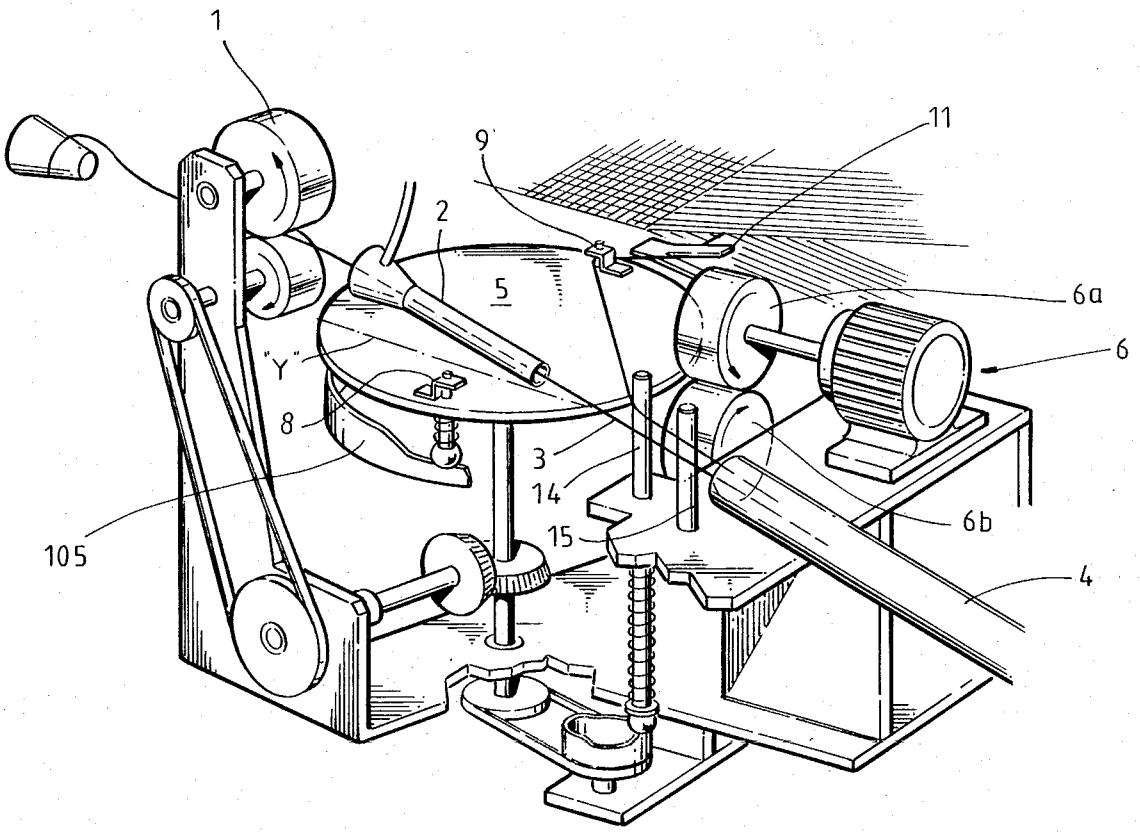
FIG. 1 is a diagram in perspective of a device built in accordance with the invention.

The attached figures, especially FIG. 1, show the device of the present invention equipped with a known delivery system of the thread 1 (measuring delivery system), rotating as to insure a delivery rate of thread corresponding to the average rate of insertion of the weft thread 3 in the weaving loom. The delivery system may be driven synchronously with the driving unit of the feeding system as shown in FIG. 1.

The thread 3 thus unwound is sucked into a chamber which is maintained at reduced pressure by any available means. By guiding the thread by means of a jet of air blasted through a nozzle 2 placed between the measuring delivery system 1 and the thread collecting unit 4, the thread remains taut and in a precisely defined position.

A plate 5 is utilized as a driving unit moving unidirectionally, and its axis is substantially orthogonal to the axes of the casting rollers. The insertion device 6 is comprised, in this design, of two casting rollers 6*a*, 6*b*. The plate 5 rotates evenly about its axis. This plate 5 carried two grippers 8, 9, positioned diametrically opposite each other on the plate 5. The plate 5 rotates at a speed equal to half of the speed of the weaving machine.

Collision of the grippers 8 and 9 as they rotate on plate 5 with the nozzle 2 can be avoided by positioning the nozzle 2 as shown in FIG. 1. The nozzle is inclined with respect to the plane formed by the surface of the plate 5. The angle is shown by the angle formed between the dot and dash line Y (which lies in the plane formed by plate 5) and thread 3 as it passes between nozzle unit 2 and collecting unit 4.

Of course, as will be readily apparent to those skilled in the art, without going beyond the scope of the invention, the plate 5 could have "n" grippers, angularly equidistant; in that case, its speed of rotation must be equal to 1/n times the speed rate of the machine. When the plate 5 rotates, the trajectory of the grippers 8, 9 is a circumference situated in the tangential plane common to both casting rollers 6*a*, 6*b*. The opening and the closing of the grippers 8, 9 are controlled by a cam 105 (partially shown), stationary with respect to the weaving machine, and mounted underneath the plate 5.

Figure 2:
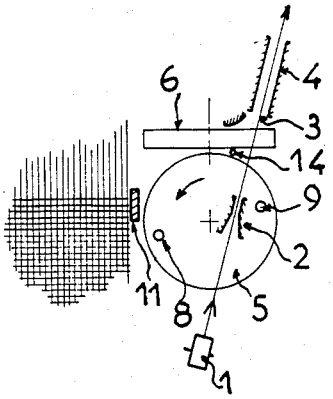
FIG. 2 is a top view of this same device.

This cam may be a bell-shaped cam if the opening and closing operations of the grippers 8, 9 consist of perpendicular motions with respect to the plate 5 as shown in FIG. 2, or it may be a radial cam if these motions of the grippers occur in a direction parallel to the plate.

FIGS. 3*a* through 3*f* show the operation of such a device.

As plate 5 rotates counterclockwise as indicated by the arrow, the gripper 8 arrives open at the level where the thread 3 enters the thread collecting unit 4. At that point the gripper 8 picks up this thread 3, and closes (FIG. 3*a*). The portion of thread 3 issuing from the delivery system 1 will continue to move towards the thread collecting unit 4, while the other portion of the thread will be pulled out of the collecting unit 4 and guided between the rollers 6*a*, 6*b* (FIG. 3*b*). As the plate 5 continues its rotation, the thread 3 reaches point (E) where it comes into contact with the generatrix common to both rollers 6*a*, 6*b* (FIG. 3*c*). The loop of thread is then formed (as described in more detail in U.S. Pat. No. 3,543,808) and cast into the shed of the weaving meachine (FIG. 3*d*) with the gripper 8 serving as the stationary point of the locked strand. As described in U.S. Pat. No. 3,543,808, the insertion system may be driven synchronously with the loom. Guide 15 is provided to assure that the cast strand 3*a* is accelerated by the casting rollers 6*a*, 6*b* for the entire length of the pick. When the loop of thread is completely unwound, the plate 5 has rotated further in its path so that the locked strand in the gripper 8 comes into contact with the blade of a cutting tool 11, and is cut between the gripper 8 and the edge of the fabric (FIG. 3*e*). The gripper 8 then opens up and the end of the thread 3 released is sucked into the thread collecting unit 4 in the direction of the arrow 40 (FIG. 3*f*). At this point a lever 14 is raised into a position such that it guides the strand of the thread 3 released from the gripper 8 so that the strand does not go through the casting rollers 6*a*, 6*b*. The raising of the lever 14 may be effectuated by any suitable conventional means, such as a cam driven synchronously with plate 5. During the part of the cycle depicted in FIGS. 3*a*–*e*, the lever 14 is retracted below the level of the thread 3. After the plate 5 has rotated half-way about its axis, the other gripper 9 arrives open at the level of the entrance to the thread storage 4, picks up the thread 3 and completes a cycle identical to the one that was just described for the first gripper 8.

Thus, all the grippers attached to the plate 5 take turns inserting a pick of weft thread in the shed of the weaving loom.

An alternative embodiment of the invention is shown in FIGS. 4*a* through 4*i*. In this alternative embodiment the plate 5 consists of an even number of means for gripping the thread: each pair consists of a gripper and of a gripper-cutting tool; the cutting tool 11 shown in FIG. 3, outside the plate 5, is eliminated. In the device shown in FIG. 4, one of the grippers 8 shown in FIGS. 1 and 3 has been replaced by a gripper-cutting tool 20.

Figure 4A:
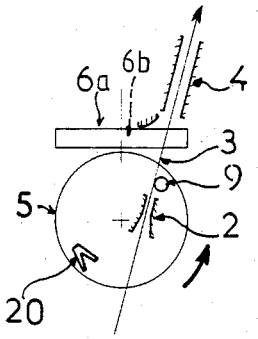
FIG. 4 describes the various phases (a to i) of an operating cycle of a variation of the invention.
Figure 4B:
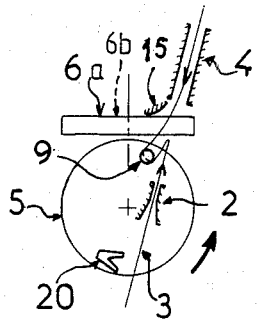
Figure 4C:
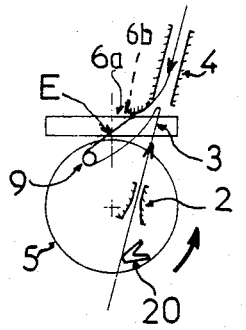
Figure 4D:
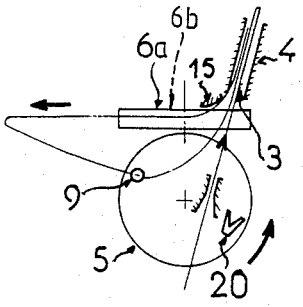

In operation of this alternative embodiment the first phases of the process for casting the pick of weft thread are identical to those described above. In FIG. 4*a*, the gripper 9 arrives open at the level of the entrance to the thread collecting unit 4 where it picks up the thread 3 and closes. As the plate 5 rotates counterclockwise the thread 3 is introduced between the casting rollers 6*a*, 6*b*. In FIG. 4*c*, the thread has arrived at point (E) on the generatrix commmon to both rollers 6*a*, 6*b*. In FIG. 4*d*, a loop of thread is shaped and cast.

Figure 4E:
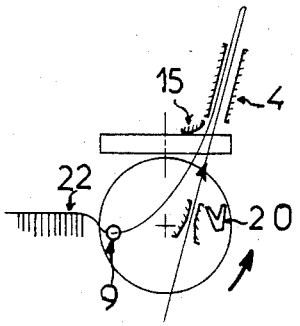
Figure 4F:
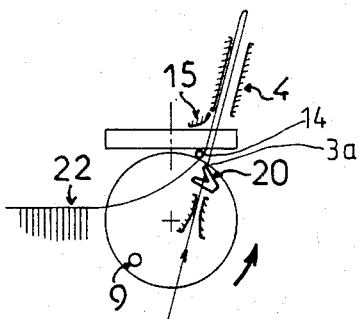

From this stage, the process is substantially different from the description given for the first embodiment described. The reed pushes against the cloth the already completed pick of weft thread which was just inserted and which is still locked in the gripper 9 (FIG. 4*e*). Then the gripper 9 open up and the thread released is sucked into the thread collecting unit 4, lever 14 being raised at this point to prevent the thread going into the casting rollers 6. Therefore, there is always in the thread collecting unit 4 a length of thread between the point after the last row of finished cloth 22 and the entrance to the thread collecting unit (FIG. 4*f*). When the gripper-cutting tool 20, positioned on the plate has rotated to bring it to the level of the entrance to the thread collecting unit 4 it cuts the free strand 39 of the thread 3, and strands 3*a* and strand 3*b* from nozzle 2, maintained apart, are sucked side-by-side into the thread collecting unit 4 (FIG. 4*g*).

Figure 4G:
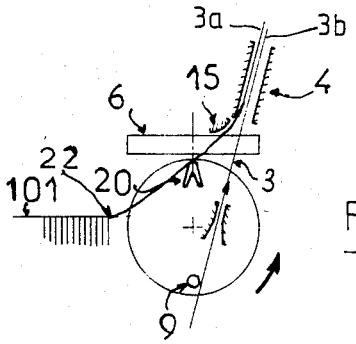
Figure 4H:
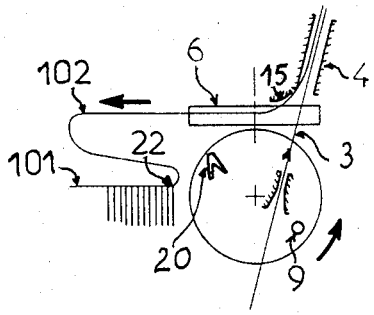
Figure 4I:
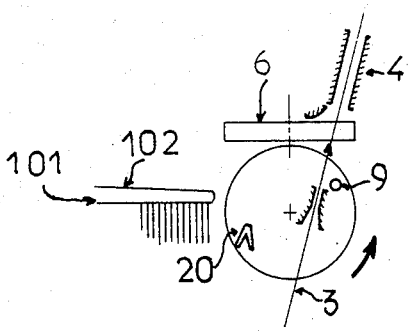

The gripper-cutting tool 20 is placed on the plate 5 in such a fashion that the rotation of plate 5 moves it from its cutting position (FIG. 4*f*) to the position shown in FIG. 4*g*, where its back comes into contact with the strand 3*a*. The strand 3*a* is held at the point after the last row of finished cloth 22 when the cutter 20 engages the thread 3*a* and pulls it to a point where it comes into contact with the generatrix common to both rollers 6*a*, 6*b*. The rollers 6*a*, 6*b*, shape the loop and cast it (FIG. 4*h*) while the point at the end of the last row of finished cloth 22 acts as the stationary point to hold the locked strand of the loop. The reed pushes the pick of weft thread thus inserted against the cloth already finished, so that the edge of the width of cloth has a true selvage on the side of the casting device. Meanwhile, the gripper 9 picks up the thread 3*b* at the entrance to the thread collecting unit 4, and the cycle starts again.

Figure 8:
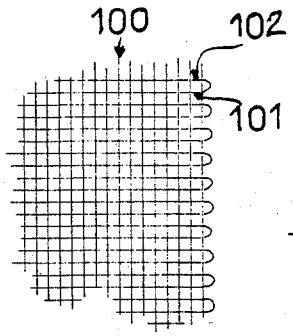
FIG. 8 shows a fabric with a true selvage obtained by means of the variation shown in FIG. 4.

This device therefore permits the insertion of picks of weft thread 101, 102, in the warp 100, without any gaps between them. In this manner, the finished cloth, as shown in FIG. 8, has a true selvage on the side of the weft thread insertion device.

Figure 5:
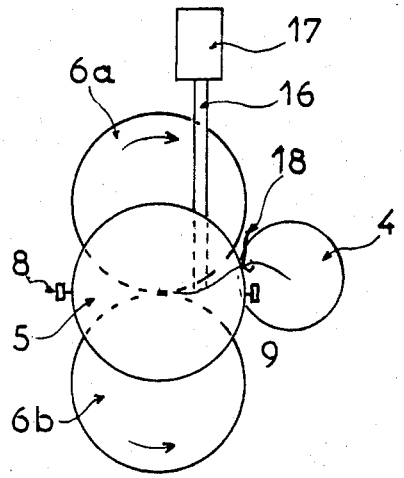
FIG. 5 is a front view of another mode of implementation of the invention.
Figure 6:
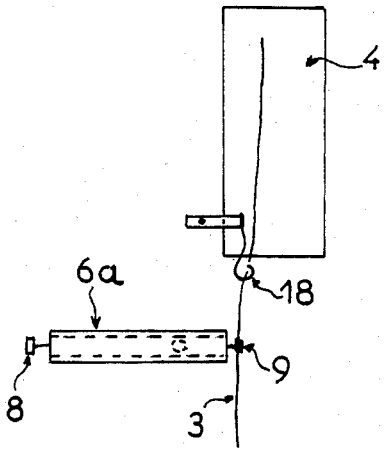
FIG. 6 shows the same implementation on a plan.

FIGS. 5 and 6 show another embodiment of the invention, in which the whole feeding system 5 unidirectionally rotates about an axis nearly parallel to the generatrix common to the casting rollers 6*a*, 6*b*. The gripping devices 8, 9 are carried by the edge of a plate 5. The thread 3 emerges from the measuring delivery system (not shown) and is sucked by the thread collecting unit 4 passing through the gripping device 9 which is a gripping-cutting tool. The gripping-cutting tool 9 stops the thread and cuts it. The free strand issuing from the delivery system keeps going towards the thread collecting unit 4, whereas the other strand from the collecting unit 4 is carried by the gripper 9 as the plate 5 rotates. A lever system 16, with a back-and-forth motion controlled by a mechanism 17 synchronized with the motion of the weaving machine, is positioned on the trajectory of the thread which is stretched between the dog's tail eyelet 18 and said lever system 16. The thread goes between the casting rollers *6a*, *6b*, and forms a loop. The lever system withdraws and the loop is cast into the shed as described above.

Figure 7:
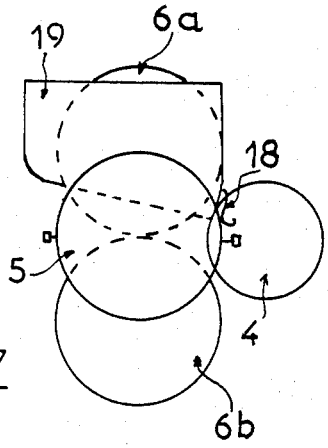
FIG. 7 is a front view variation of FIG. 5.

FIG. 7 shows an identical device, but in this device the mobile lever system 16 is replaced by a deflector 19. This part, attached between the casting rollers *6a*, *6b* and the rotating plate 5, guides the thread until it is inserted between the casting rollers.

Figure 9:
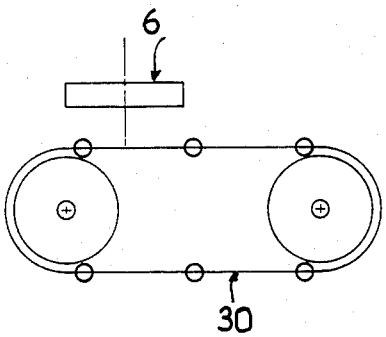
FIG. 9 shows another mode of the system moving unidirectionally, permitting introduction the pick of weft thread into the insertion device.
Figure 3:
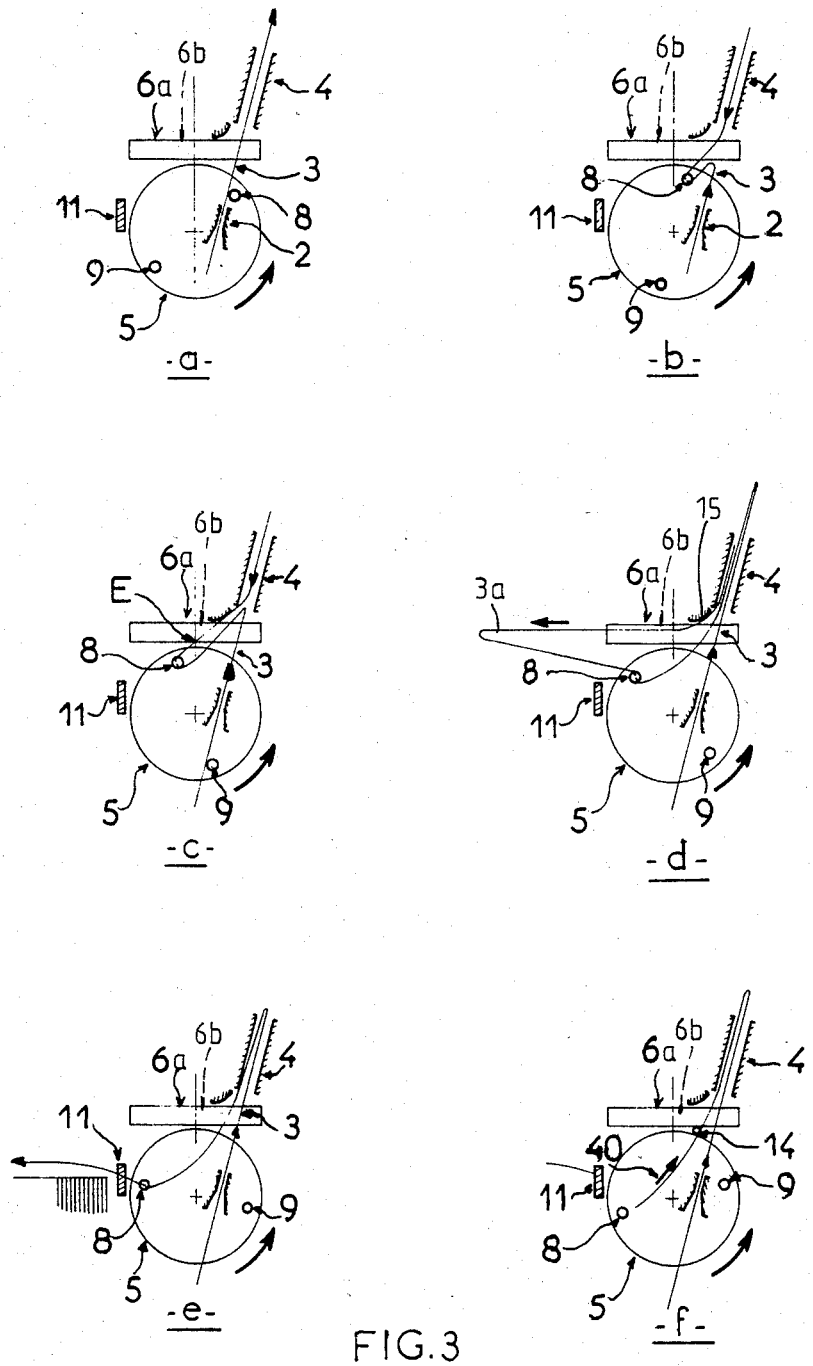
FIG 3 shows the various phases (referenced a, b, c, d, e, f) of an operating cycle of a device operating in accordance with the invention.

Without going beyond the limits of the scope of the invention, the plate 5 described in the two above-mentioned designs may be reduced to a hub equipped with a certain number of arms carrying the gripping device. Alternatively, the plate 5 may be replaced by a chain or an endless belt 30 (see FIG. 9), on which are attached grippers and cutting tools in the same way they were attached to the plate 5. This endless conveyor is driven by any proven means at a speed equal to 1/n times the speed rate of the weaving machine, if it carries "n" means for the insertion of the thread.

It will be readily apparent to those in the art that the invention is not limited to the particular embodiments previously described, but that it may also apply to all the variations thereof. Thus, in some cases, it may be best to accelerate the plate motion in order to facilitate the catching of the thread, for instance between the positions of FIGS. *3a* and *3b*, while the plate motion may be slower during the rest of the course. Such a undirectional motion may be transmitted for instance by means of a Maltese Cross System. Alternatively, a time for a pause may be planned without going beyond the limits of the invention.

Finally, as mentioned before, such a device may be easily adapted to shuttleless looms, utilizing for casting the thread with other types of mechanism than casting rollers.

What is claimed is:

1. Device for the insertion of a weft thread into the shed of a weaving loom comprising:

a delivery system;

a thread collecting unit for receiving thread from the delivery system;

an insertion system, placed between the delivery system and the thread collecting unit for inserting a pick of weft thread into the shed between the warp threads;

a feeding system which is adapted to be driven to cooperate with said insertion system to transfer a pick of weft thread from the thread collecting unit to the insertion system;

said feeding system including:

driving means adapted to be moved during driving of the feeding system through a set path which is outside the operative zone of the insertion system but which intersects the trajectory of thread between the delivery system and the thread collecting unit, and gripping means mounted on the driving means adapted to engage such a pick of weft thread and carry the thread into the operative zone of the insertion system for insertion thereby.

2. A device according to claim 1, in which the gripping means comprises a plurality of gripper devices provided on the feeding system.

3. The device of claim 2, wherein the feeding system is adapted to be driven for each gripper device to engage with and to pull a strand of thread towards the point following the last row of finished cloth such that said thread can be inserted into the shed in the shape of a loop.

4. The device of claim 1, wherein the insertion system includes a pair of casting rollers adapted to cast the pick of weft thread in the shape of a loop with one locked strand and one cast strand; and in which the gripping means is adapted to be moved in one direction to introduce the pick of weft thread between the rollers.

5. The device of claim 4, further comprising:

cutting means placed between the last row of finished cloth and the gripping means when the gripping means is positioned near to and is holding such a locked strand close to said last row, the cutting means being adapted to cut said locked strand after said loop has been cast.

6. The device of claim 1, wherein said thread collecting unit is adapted to stretch thread collected therein with a jet of air such that thread entering said thread collecting unit follows a substantially consistent path.

7. The device of claim 4, whrein the thread collecting unit is further adapted to store the prepared pick of weft thread in a plane close to the tangential plane common to both casting rollers.

8. The device of claim 4, wherein the gripping means comprises a plurality of gripper devices which are adapted to describe a circumference in a unidirectional continuous motion during driving of the feeding system, and in which the device further comprises a cam adapted to control the opening and the closing of the gripper devices.

9. The device of claim 8, wherein the feeding systems is adapted to be driven such that the gripper devices describe in a unidirectional continuous motion a circumference nearly in the tangential plane common to the casting rollers.

10. The device of claim 8, wherein the feeding system is adapted to be driven such that the gripper devices describe a circumference in a plane nearly perpendicular to the tangential plane common to the casting rollers.

11. The device of claim 8, wherein the feeding means has "n" gripper devices positioned thereon at equally spaced intervals from each other, and in which the feeding system is adapted to be rotatably driven at a speed equal to 1/n times the rate at which the weaving machine is to be driven.

12. The device of claim 8, wherein the gripper devices are gripping-cutting tools adapted to hold the thread below the cutting point.

13. The device of claim 8, wherein the feeding system comprises an even number of gripper devices and every other gripper device is a gripping-cutting tool such that the device is adapted to feed pairs of picks of weft thread without any gap between them.

14. The device of claim 1, wherein the feeding system comprises an endless conveyor having gripping means in the form of a plurality of gripper devices provided at spaced intervals along the conveyor.

15. The device of claim 5, further comprising cut strand guidance means adapted to prevent thread released after said locked strand has been cut by said cutting means from coming into contact with said casting rollers.

* * * * *

UNITED STATES PATENT AND TRADEMARK OFFICE

CERTIFICATE OF CORRECTION

PATENT NO. : 4,509,563

DATED : April 9, 1985

INVENTOR(S) : Guy Gosciniak et al.

It is certified that error appears in the above-identified patent and that said Letters Patent are hereby corrected as shown below:

In the Abstract line 17, delete "or" and insert --of--.

Column 5, line 35, delete "meachine" and insert --machine--.

Column 6, line 12, delete "commmon" and insert --common--;

Column 6, line 19, delete "open" and insert --opens--;

Column 6, line 28, delete "39" and insert --3a--.

Column 7, line 32, delete "undirectional" and insert --unidirectional--.

UNITED STATES PATENT AND TRADEMARK OFFICE

CERTIFICATE OF CORRECTION

PATENT NO. : 4,509,563

DATED : April 9, 1985

INVENTOR(S) : Guy Gosciniak et al.

It is certified that error appears in the above-identified patent and that said Letters Patent is hereby corrected as shown below:

Column 8, line 24, delete "whrein" and insert --wherein--.

Signed and Sealed this

*Fifteenth* Day of *October 1985*

[SEAL]

*Attest:*

DONALD J. QUIGG

*Attesting Officer*

*Commissioner of Patents and Trademarks—Designate*